US005708906A

United States Patent [19]

Hashizume

[11] Patent Number: 5,708,906

[45] Date of Patent: Jan. 13, 1998

[54] FILM PROCESSOR AND METHOD OF PROCESSING A PHOTOGRAPHIC FILM

[75] Inventor: Keiji Hashizume, Wakayama, Japan

[73] Assignee: Noritsu Koki Co., Ltd., Wakayama, Japan

[21] Appl. No.: 412,156

[22] Filed: Mar. 28, 1995

[30] Foreign Application Priority Data

| | | | |
|---|---|---|---|
| Mar. 28, 1994 | [JP] | Japan | 6-057704 |
| Apr. 5, 1994 | [JP] | Japan | 6-067348 |
| Apr. 5, 1994 | [JP] | Japan | 6-067349 |

[51] Int. Cl.[6] ..... G03D 3/08

[52] U.S. Cl. ..... 396/620; 396/613

[58] Field of Search ..... 354/319–321; 355/77; 369/613, 622, 567, 594; 226/92, 91; 156/159, 304, 361; 396/594, 595, 599, 600, 612, 613, 620, 622

[56] References Cited

U.S. PATENT DOCUMENTS

| | | | |
|---|---|---|---|
| 4,094,726 | 6/1978 | Hujer et al. | 396/599 |
| 4,239,367 | 12/1980 | Hope et al. | 395/613 |
| 4,411,725 | 10/1983 | Siegel et al. | 396/600 |
| 4,561,924 | 12/1985 | Hope et al. | 156/361 |
| 4,935,809 | 6/1990 | Hayashi et al. | 355/38 |
| 5,093,686 | 3/1992 | Shigaki | 355/77 |
| 5,444,513 | 8/1995 | Staheli et al. | 396/622 |
| 5,473,402 | 12/1995 | Long et al. | 354/321 X |

*Primary Examiner*—D. Rutledge

*Attorney, Agent, or Firm*—Wenderoth, Lind & Ponack

[57] ABSTRACT

A plurality of films contained within a respective plurality of cartridges are successively spliced together and transferred to a development processing station. The leading end of a first film is drawn out from its respective cartridge and transferred to a splicer. At the splicer, a film leader is spliced to the leading end of the first film. The film leader having the leading end of the first film spliced thereto is transferred to the development processing station to cause the trailing end of the first film to arrive at the splicer. Then, at the splicer, the leading end of a second film is spliced to the trailing end of the first film. In this manner, a string of films is spliced together and transferred to the film development station, with the leading end of the first film having the film leader spliced thereto.

2 Claims, 18 Drawing Sheets

FILM PROCESSOR AND METHOD OF PROCESSING A PHOTOGRAPHIC FILM

BACKGROUND OF THE INVENTION

The present invention relates to a film processor for processing an undeveloped photographic film carrying images and brought to a DP shop and to a method of processing the photographic film.

In a conventional film processor, a full length of film is joined to a film leader for ease of feeding to a development station and subjected to a development process. After developed, the film is separated from the film leader and coupled at its trailing end to the leading end of another developed film thus producing a string of the films which are then wound on a takeup reel.

The conventional film processor includes a step of separating each developed film of a full length from its film leader followed by a step of joining the developed films to one another. This will increase the overall process duration decreasing the working efficiency.

More particularly, an operator of the conventional film processor has to draw the leading end of an undeveloped film 81 of a full length from its cartridge 80 and join it to a film leader 82 by a strip of splicing tape 83, as shown in FIG. 31, before feeding the film leader 82 with the film 81 across a series of processing tubs of the development process.

Accordingly, it is needed to separate each developed film 81 of a full length from its film leader and join the developed films 81 to one another to form a string of the films 81 for ease of the development process. The overall duration of the development process will thus be increased declining the working efficiency.

In a conventional photographic film processing method, a photographic film carrying undeveloped images is separated from its cartridge, subjected to the development process, and cut into negative pieces of a given length including e.g. 6 frames. The negative pieces of the developed film are then handed together with their finished prints to a client while the cartridge is discarded.

As the result, such a conventional method creates the disposal of a large number of empty cartridges as industrial wastes and fails to provide the material saving. The negative pieces of developed films having a given length are bulky and not adequate for storage in a limited space. In addition, the method has to include a step of cutting each developed film of a full length into negative pieces and a step of inserting the negative pieces into pockets of a storage sheet respectively and will hardly be improved in the working efficiency.

It is an object of the present invention, in view of the above background, to provide an improved film processor characterized in that the steps of separating a developed film from its film leader and joining the developed film to another developed film are eliminated, that the steps of cutting each developed film into negative pieces and inserting the negative pieces into pockets of a storage sheet respectively are eliminated, and that the film cartridges accommodating undeveloped films are recovered for reuse, whereby the working efficiency will be increased and the handling and storage of the films will be eased. Another object of the present invention is to provide a photographic film processing method of the same.

SUMMARY OF THE INVENTION

A film processor for transferring with the guidance of a film leader a film supplied from a cartridge to a development station for development process, comprises: a feeding means for drawing out the film from its cartridge; a joining means for joining the leading end of the film to the film leader; a leader transferring means for transferring the film leader with the film to the development station; and a joining means for joining the trailing end of the film departed from the cartridge with the leading end of a succeeding film, wherein a string of the films joined to the film leader are subjected to the development process.

A film processor for transferring with the guidance of a film leader a film supplied from a cartridge to a development station for development process, comprises: a feeding means for drawing out the film from its cartridge; a joining means for joining the leading end of the film to the film leader; a cutting means for separating the trailing end of the film from the cartridge; a leader transferring means for transferring the film leader with the film to the development station; and a joining means for joining the trailing end of the film separated from the cartridge with the leading end of a succeeding film, wherein a string of the films joined to the film leader are subjected to the development process.

A photographic film processing method comprises the steps of drawing out from a cartridge a photographic film carrying undeveloped images, separating the film from the cartridge, joining the trailing end of the film to the leading end of a succeeding film to form a string of the films, subjecting the string of the films to a development process, cutting the string of the developed films into the original lengths and subjecting them to a printing process, and rewinding and accommodating each of the developed films in its cartridge.

A photographic film processing method comprises the steps of drawing out from a cartridge a photographic film carrying undeveloped images, separating the film from the cartridge, subjecting the film to a development process, printing the developed images in the film onto photosensitive materials, and rewinding and accommodating the film in its cartridge after the printing process.

A photographic film processing method comprises the steps of drawing out from a cartridge a photographic film carrying undeveloped images, separating the film from the cartridge, subjecting the film to a development process, and rewinding and accommodating the film in its cartridge after the development process.

In the film processor, the (first) film drawn out from the cartridge is joined at its leading end to the film leader and at the trailing end with the leading end of the other (second) film which is in turn joined at its trailing end with a succeeding (third) film. A number of the undeveloped films are joined to one another forming a string of the films which is then transferred across a series of processing tubs of the development process In the film processor, the (first) film drawn out from the cartridge is joined at its leading end to the film leader and separated at its trailing end by the cutting means from the cartridge. The trailing end of the first film is then joined with the leading end of the other (second) film.

The second film is also separated at its trailing end by the cutting means from the cartridge and joined with the leading end of a succeeding (third) film in the same manner.

A resultant string of the undeveloped films joined to one another are transferred to the development station where they are subjected in succession to the development process.

According to the photographic film processing method, the photographic film carrying undeveloped images is separated from its cartridge and joined at its trailing end with the leading end of a succeeding film. A resultant string of the films joined to one another are subjected to the development and separated into its original lengths before subjected to the printing process. After the printing process, each of the developed films is rewound and accommodated in its cartridge.

According to the photographic film processing method, the photographic film carrying undeveloped images is separated from its cartridge and subjected to the development process. When the developed film has been subjected to the printing process, it is rewound and accommodated in its cartridge.

According to the photographic film processing method, the photographic film carrying undeveloped images is separated from its cartridge and subjected to the development process. The developed film is then rewound and accommodated in its cartridge.

DETAILED DESCRIPTION OF THE PREFERRED EMBODIMENTS

Figure 1:
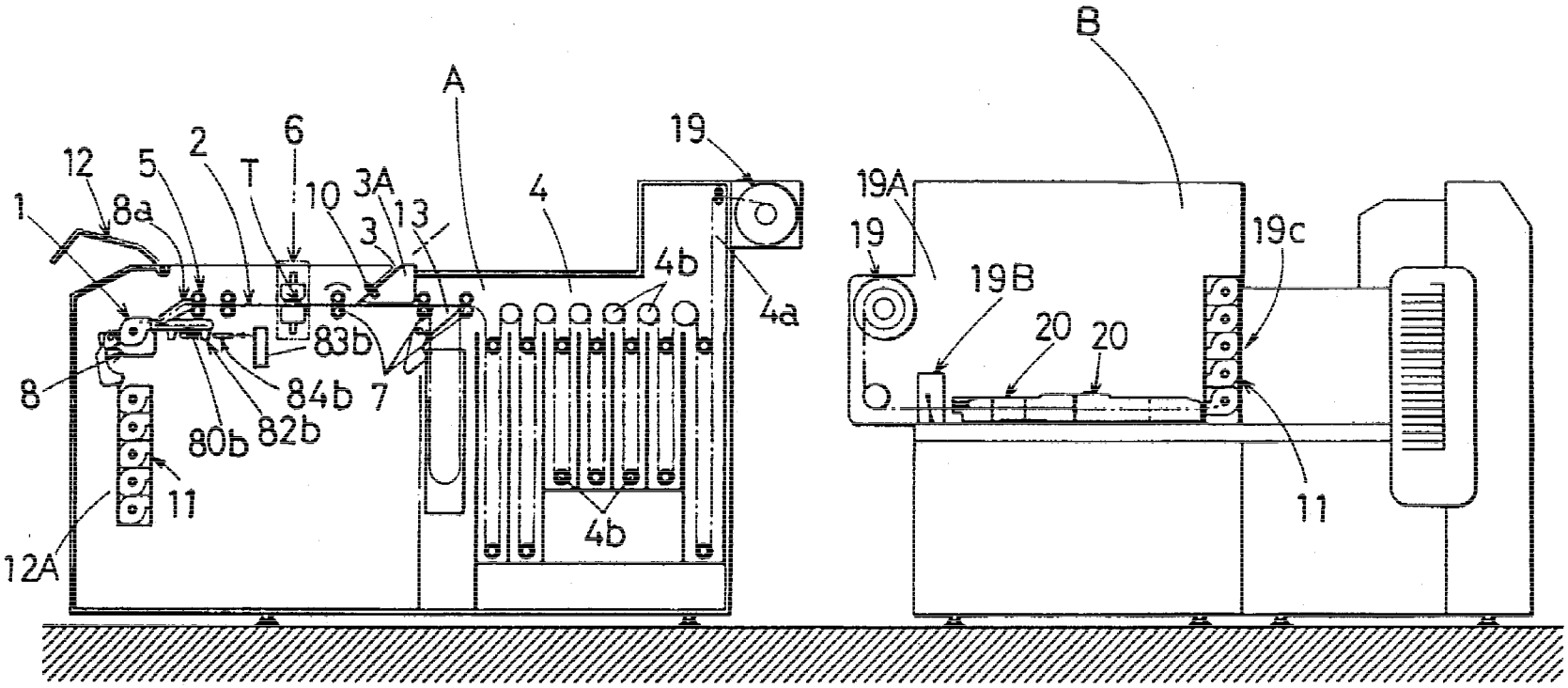
FIG. 1 is a front cross sectional view of a film processor showing an embodiment of the present invention.

FIG. 1 illustrates a processor system for processing a photographic film according to the present invention, which comprises a film processor A and a printer processor B.

The film processor A is provided for guiding a film 2 fed from a cartridge 1 and joined with a film leader 3 to a development station 4 for photographic development process. The film processor A comprises a pair of feed rollers 5 for drawing out the film 2 from the cartridge 1, a splicer 6 for joining the film 2 with the film leader 3, and a pair of leader transfer rollers 7 for advancing the film leader 3 to the development station 4 (FIG. 1).

The splicer 6 has also a function of joining the trailing end of a preceding film 2A departed out from its cartridge 1 to the leading end of a succeeding film 2B.

The cartridge 1 serves as a film leading end feeder for feeding out the leading end of the film 2 through a front opening **1*b* of its casing 1*a* by rotating a spool 1A in a direction opposite to the loading of the film 2**.

The casing 1a of the cartridge 1 is arranged to have a film room **1*g* sized almost equal to or slightly larger than the maximum diameter of a roll of the film 2 on the spool 1A**.

Figure 2:
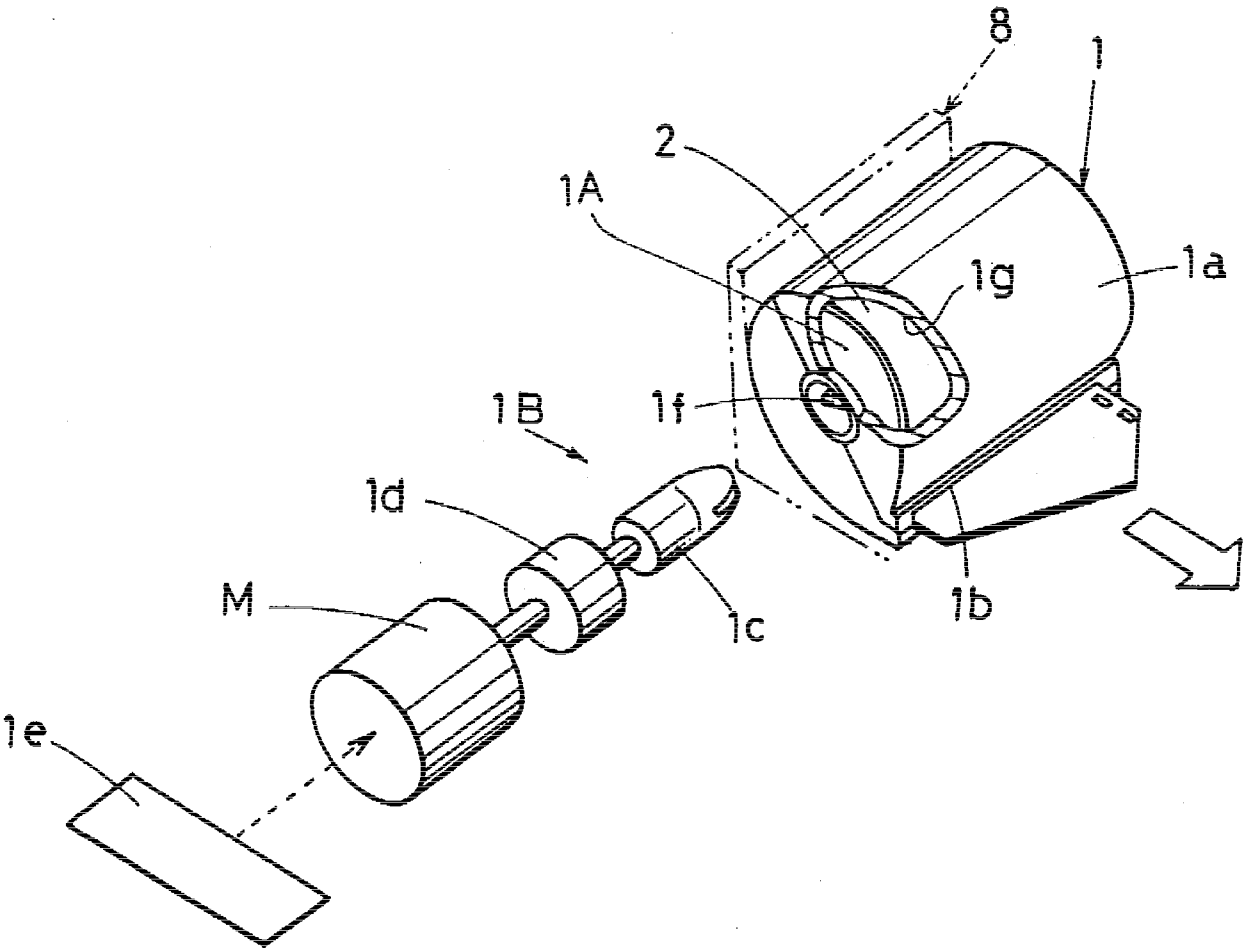
FIG. 2 is a perspective view of a film cartridge of the embodiment.

The leading end feeder 1B of the cartridge 1 comprises a cartridge holder 8 and a spool rotary shaft **1*c* driven via a torque limiter 1*d* by a motor M, as shown in FIG. 2. A shifter 1*e* is also provided for moving the spool rotary shaft 1*c* in its axial direction to and from an engagement location where it is engaged with an engaging end if of the spool 1A**.

As the spool 1A is rotated in the direction opposite to the loading of the film 2, the leading end of the film 2 is released from the cartridge 1 across the opening **1*b* of the casing 1*a*** to the outside.

The spool 1A includes two takeup arms 4A and 4B provided with one catch tab **4*a* and a pair of holddown projections 4*b*** respectively.

Figure 8:
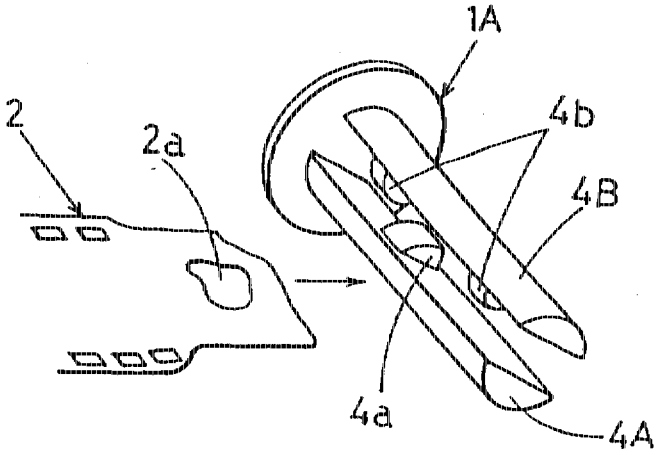
FIG. 8 is a perspective view showing joining of a film to the spool of the embodiment.
Figure 9:
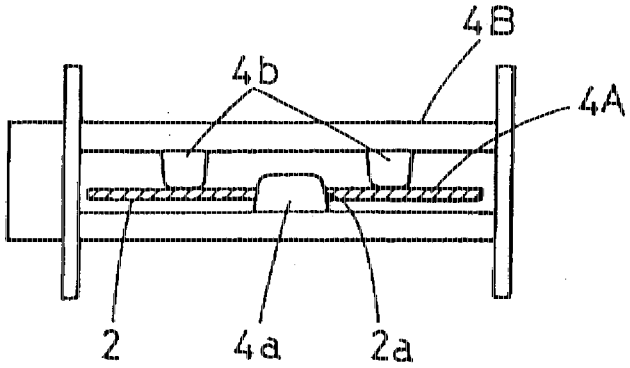
FIG. 9 is a side view showing the joining of the film to the spool of the embodiment.
Figure 10:
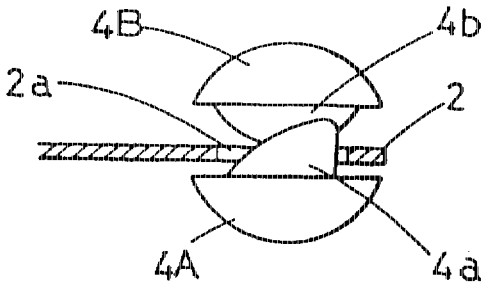
FIG. 10 is a front cross sectional view showing the joining of the film to the spool of the embodiment.
Figure 11:
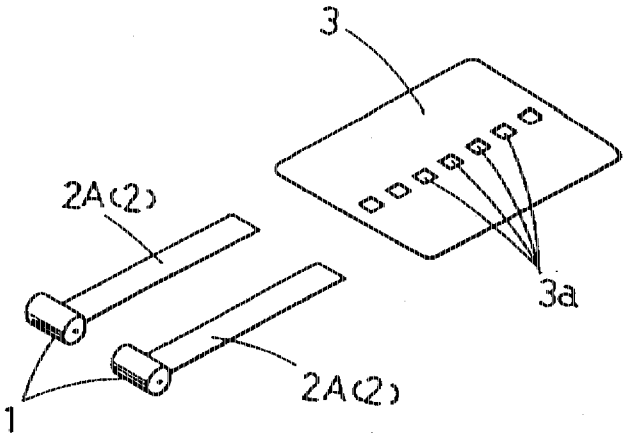
FIG. 11 is a perspective view of joining a film to a film leader according to the embodiment.

The film 2 has an engaging slot **2*a* provided in the trailing end thereof for accepting the catch tab 4*a* of the spool 1A so that the film 2 can securely be held at both sides with the two projections 4*b* (FIGS. 8 to 10**).

The cartridge holder 8 comprises two, left and right, guides **8*a* for guiding the advancing movement of the film 2 from the cartridge 1 and a removal mechanism 8*b* for unloading the film 2 from the cartridge 1**.

Figure 3:
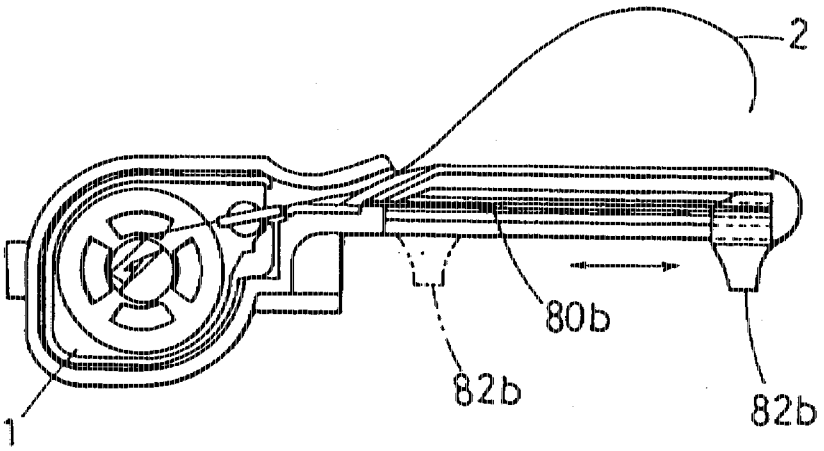
FIG. 3 is a front view of a film holder of the embodiment.
Figure 4:
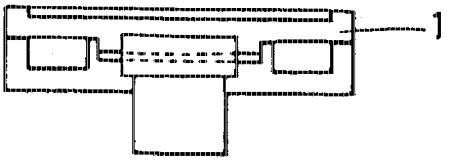
FIG. 4 is a side view of the film holder of the embodiment.
Figure 5:
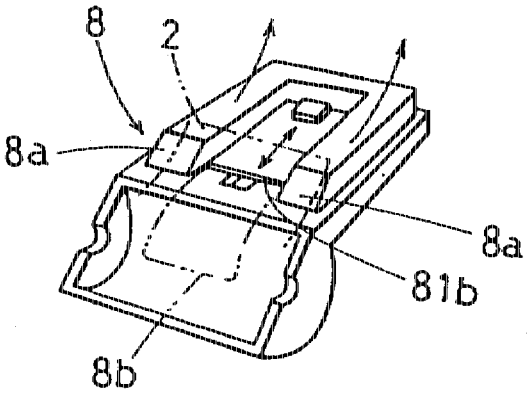
FIG. 5 is a perspective view of the film holder of the embodiment.

The removal mechanism 8b includes a film removal plate 80b for disengaging the catch tab 4a of the spool 1A from the engaging slot 2a of the film 2. The film removal plate 80b is mounted to the cartridge holder 8 for outward and inward movements across a projection opening 81b of the holder 8. The outward and inward movement of the film removal plate 80b is performed by a film unloading lever 82b which is controlled by an actuator 84b linked to a solenoid 83b (FIGS. 3 to 5).

Figure 6:
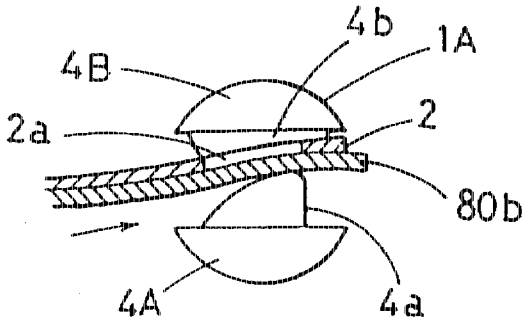
FIG. 6 is a front cross sectional view showing separation of a film from a spool of the embodiment.
Figure 7:
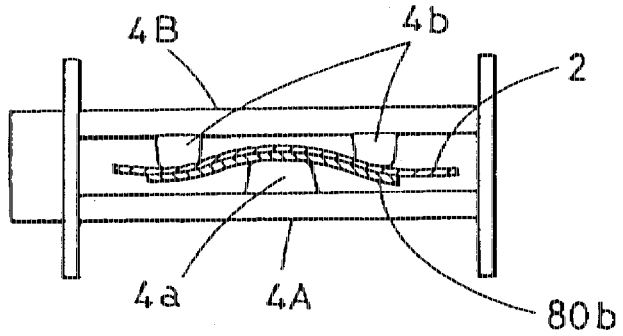
FIG. 7 is a side view showing the separation of the film from the spool of the embodiment.

In action, when the film removal plate 80b is projected out from the opening 81b of the holder 8 and inserted into the opening 1b of the cartridge 1 between the two takeup arms 4A and 4B of the spool 1A, it lifts up the film 2 to release its engagement with the catch tab 4a (FIGS. 6 and 7).

A cover 12 is mounted above the cartridge holder 8 for opening and closing of the processor A.

Provided beneath the cartridge holder 8 is a cartridge recovery container 11 which is detachably mounted in a cartridge container storage 12A. The cartridge recovery container 11 is a cassette type box having an opening provided in the top thereof.

The film leader 3 is designed for ease of guiding the film 2 to the development station for film development and made of a sheet of a resilient synthetic resin material. The film leader 3 has a row of perforations 3a provided in the center thereof lengthwisely of the film 2 (FIGS. 11 to 14).

Two of the films 2 from their respective cartridges 1 are joined by strips of splicing tape T to the rear end of the film leader 3.

The film leader 3 stored in a film leader storage 3A is supplied by action of a pair of leader feed rollers 10 and transferred by the action of the leader transfer rollers 7 to the splicer 6 where it is placed in position.

The development station 4 contains processing tubs for development, bleaching, settlement, rinsing, and drying. The film 2 processed and released from an exit 4a of the drying tub is rewound on a takeup reel 19.

A leader transfer roller means 4b which comprises sprockets and belts is provided along the processing tubs in the development station 4 so that the film leader 3 with the films 2 is advanced by action of the sprockets engaging with its perforations 3a.

The printer processor B comprises a cartridge container storage 19C to which the cartridge recovery container 11 containing a number of the empty cartridges 1 and a reshaping station 19B for reshaping the films 2 unloaded from the takeup reel 19 before separating them to feed in a sequence to an automatic negative masking station for printing. After the printing process, the films 2 are examined for corresponding to its finished prints.

Figure 17:
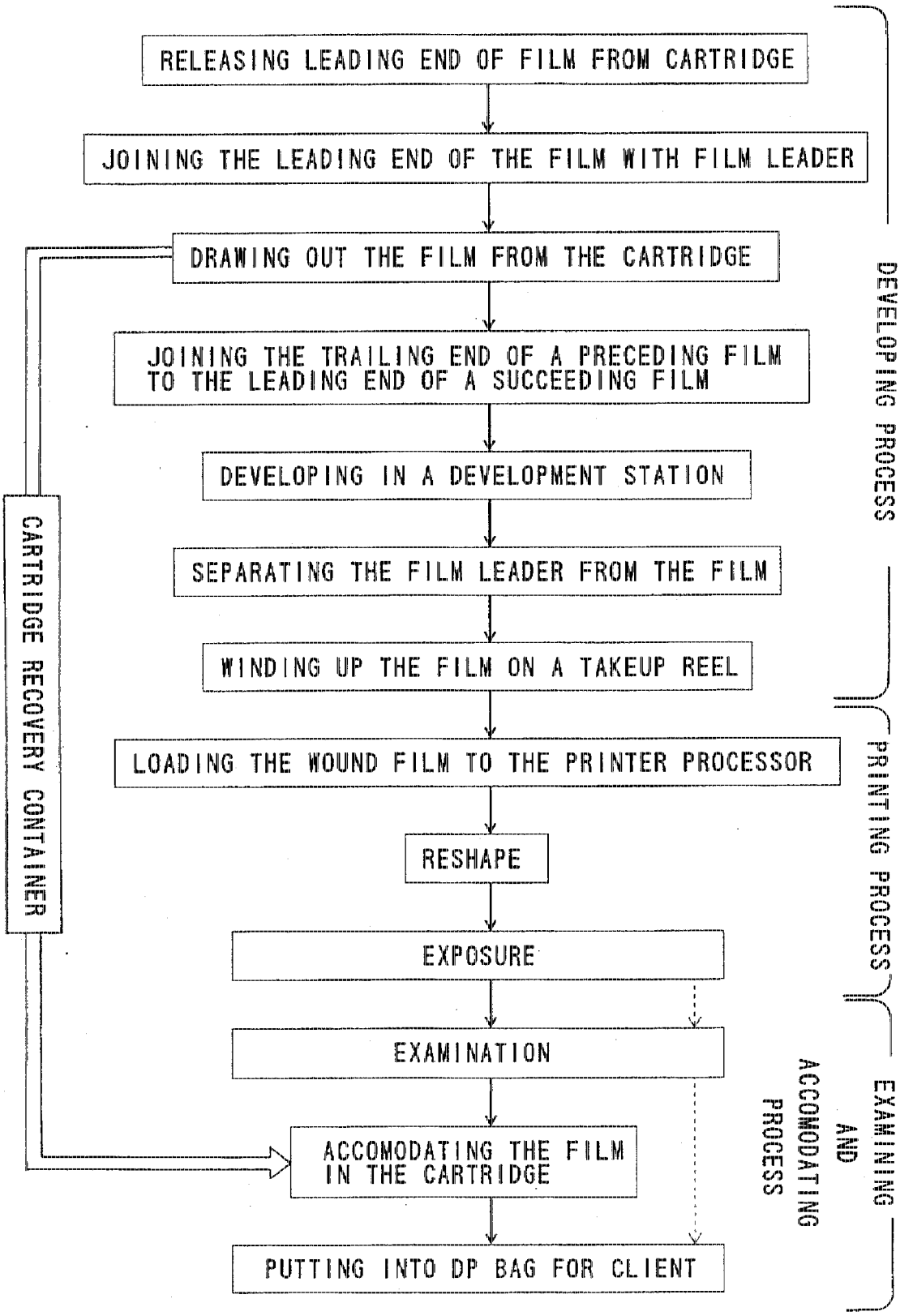
FIG. 17 is a flow chart of a photographic film processing method showing another embodiment of the present invention.

The steps of a photographic film processing method executed in the processor system shown in FIG. 1 will be described in conjunction with a flow chart of FIG. 17.

1. The spool 1A is rotated in the unloading direction to release the leading end of the film 2A from its cartridge 1.

2. The film 2A is transferred to the splicer 6 as being guided between the guides 8a of the cartridge holder 8 and nipped between the feed rollers 5.

3. Meanwhile, the film leader 3 is supplied by the action of the feed rollers 10 and carried along a film path by the action of the transfer rollers 7 to the splicer 6.

Figure 12:
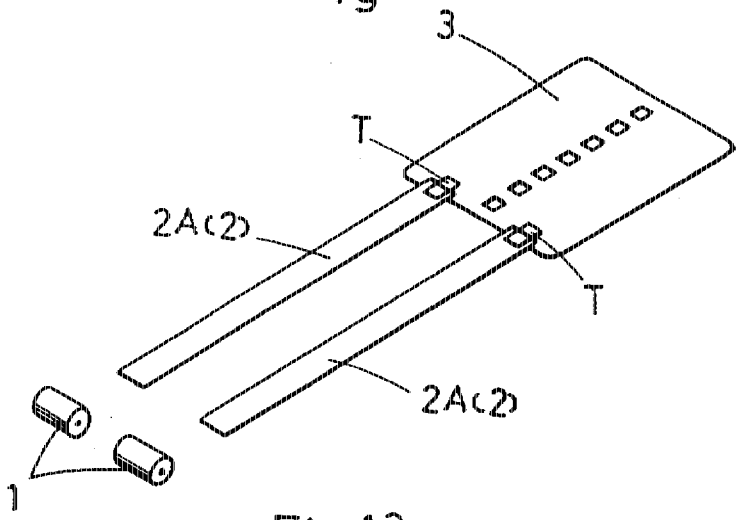
FIG. 12 is a perspective view showing the joined film according to the embodiment.

4. The leading end of the film 2A is joined by a strip of the slicing tape T to the film leader 3 in the splicer 6 (FIG. 12).

5. The film leader 3 with the film 2 is transferred by the action of the leader transfer rollers 7 to the development station 4.

6. When the trailing end of the film 2 is about to depart from the cartridge 1, its film end signal causes the solenoid 83b to actuate the film removal lever 82b for disengaging the trailing end of the film 2 from the spool 1A (FIG. 12).

The film end signal is released when an end mark recorded on the film 2 or a given rate of tension corresponding to near-end movement of the film 2 is detected.

7. When the film 2 has been separated from the spool 1A, the cartridge holder 8 is opened for discarding the cartridge 1 into the cartridge recovery container 11.

Upon the cartridge holder 8 being placed back to its original location, the cover 12 is opened for loading a succeeding cartridge 1.

8. The film 2A separated from the preceding cartridge 1 is further advanced until its trailing end comes to the splicer 6.

Also, a (second) film 2B is drawn out from the succeeding cartridge 1 in the same manner as described and guided to the splicer 6 as being nipped between the feed rollers 5.

Figure 13:
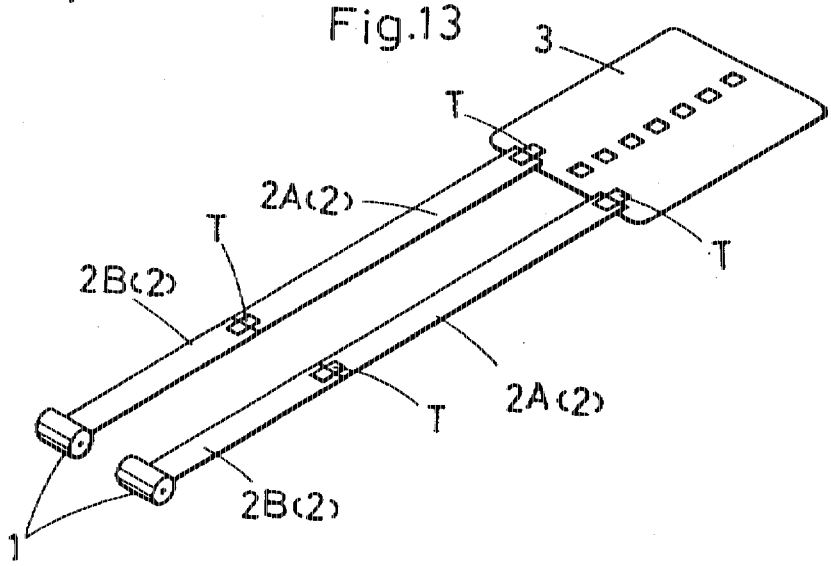
FIG. 13 is a perspective view of joining the films according to the embodiment.

9. At the splicer 6, the training end of the (first) preceding film 2A is joined by a strip of the splicing tape T to the leading end of the (second) succeeding film 2B (FIG. 13).

Figure 14:
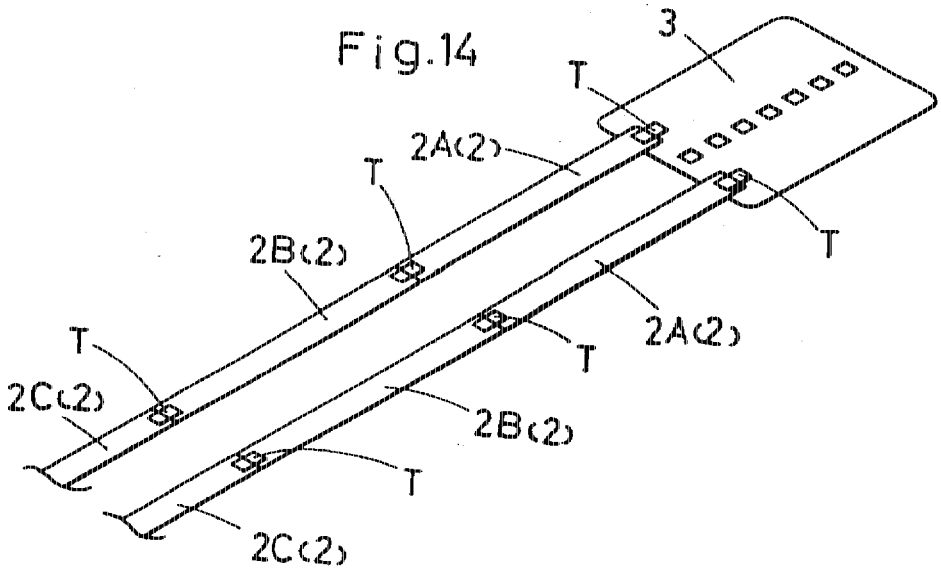
FIG. 14 is a perspective view of joining more of the films according to the embodiment.

10. By repeating the above steps, a desired number of films 2 including a third, a fourth, and so on are joined one after another (FIG. 14).

11. A string of the films 2A, 2B, 2C . . . are subjected one after another to the development process of the development station 4.

12. After the development process, the film leader 3 is separated by a cutting means (not shown) from the leading end of the preceding film 2A. The string of the developed films 2A, 2B, 2C . . . are then wound on a takeup reel 19.

Accordingly, it is unnecessary to separate each undeveloped film from its leader and to join developed films to one another.

13. The string of the developed films 2A, 2B, 2C . . . on the takeup reel 19 are then loaded to the printer processor B for printing.

The film processor also includes a loop guide 13 where a known film reservoir is provided for temporary holding of a length of undeveloped film so that the development process is never affected by any delay of the film joining action.

14. When the cartridge recovery container 11 is filled up with a desired number of empty cartridges 1, it is placed upside down in the cartridge container storage 19C of the printer processor B.

15. The takeup reel 19 with the string of the developed films wound thereon is loaded to a film feeder 19A in the print processor B.

16. The string of the developed films 2 is then drawn out from the takeup reel 19, separated to original lengths by a press cutter (not shown), and reshaped with the reshaping station 19B before fed to the automatic negative mask 20.

Figure 15:
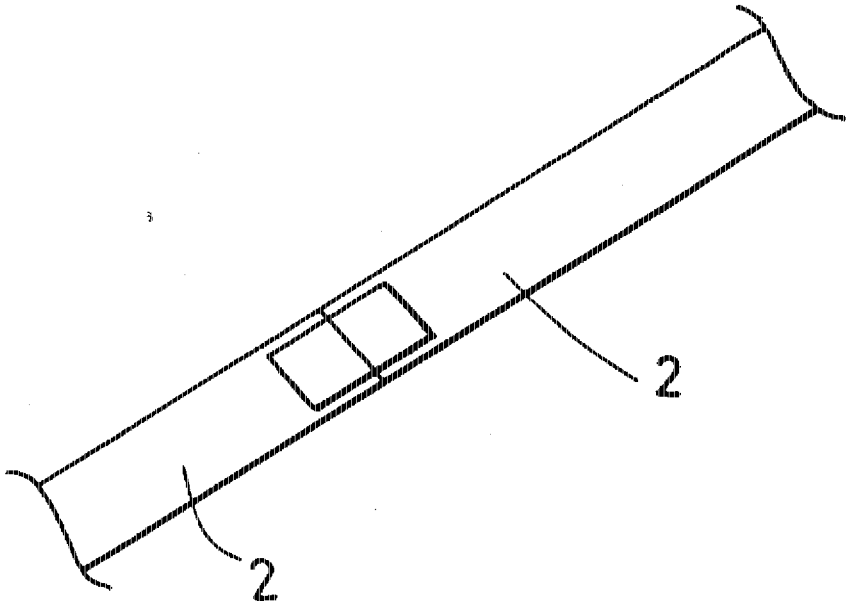
FIG. 15 is a perspective view showing reshaping of films according to the embodiment.
Figure 16:
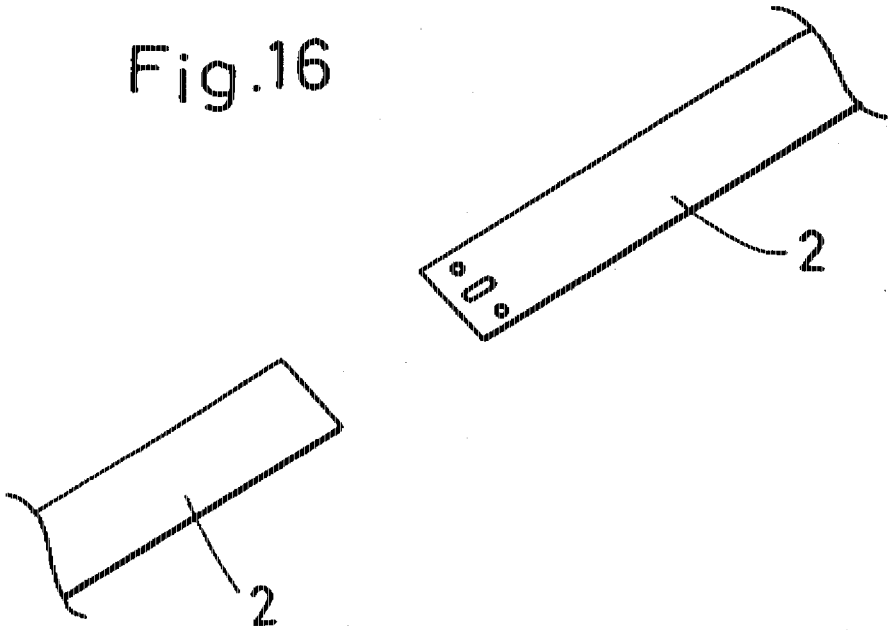
FIG. 16 is a perspective view showing reshaping of films according to the embodiment.

More particularly, as the developed films 2 have been separated from each other, both the trailing end of a preceding film and the leading end of a succeeding film are reshaped by press cutting to their original forms for ease of joining to the cartridge 1 and to the leader 3 respectively (FIGS. 15 and 16).

17. Each of the separated films 2 is subjected to an exposure process for printing.

18. After the exposure process, the film 2 is examined for corresponding to finished prints.

19. The film 2 is accommodated in its cartridge 1 which is supplied by means of gravity drop from the cartridge recovery container 11.

20. The film 2 accommodated in the cartridge 1 is finally returned to a client with its finished prints in a DP bag.

Another embodiment of the present invention in the form of a photographic film processing method will be described.

According to this embodiment, one or two undeveloped films 2 are joined to a film leader 3 for being subjecting to the development process and after the development process, are separated from the leader 3 for being subjecting to the exposure process before accommodated in their respective cartridges 1.

Figure 18:
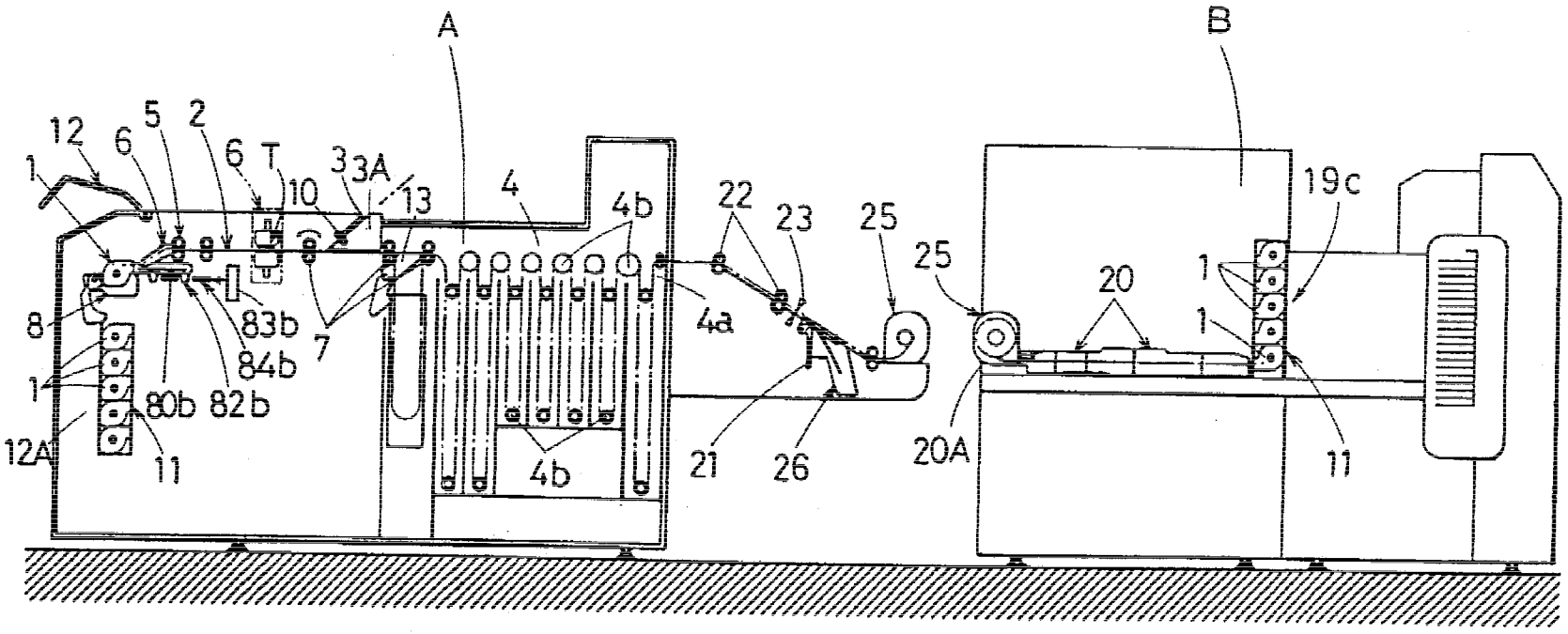
FIG. 18 is a front cross sectional view of a film processor showing a further embodiment of the present invention.

FIG. 18 illustrates a processor system comprising a film processor A and a printer processor B.

The arrangement of the film processor A and the print processor B is identical to that of the first embodiment and like components are denoted by like numerals as will be explained in no more details.

In the film processor A, the film leader 3 is joined to one or two undeveloped films 2 before being transferred to the development process. After the development process, the leader 3 advanced by transfer rollers 22 is separated by a cutter 23 from the films 2 and guided by separation guide 21 to a film leader recovery container 26. Simultaneously, the films 2 are taken up in a magazine 25 (FIG. 18).

The printer processor B has no reshaping station where a string of the films is separated to original lengths and reshaped before the exposure process. The printer processor B starts its printing action systematically when the magazine 25 containing the developed films 2 is placed in an automatic negative mask station 20A with an automatic negative mask 20.

Figure 23:
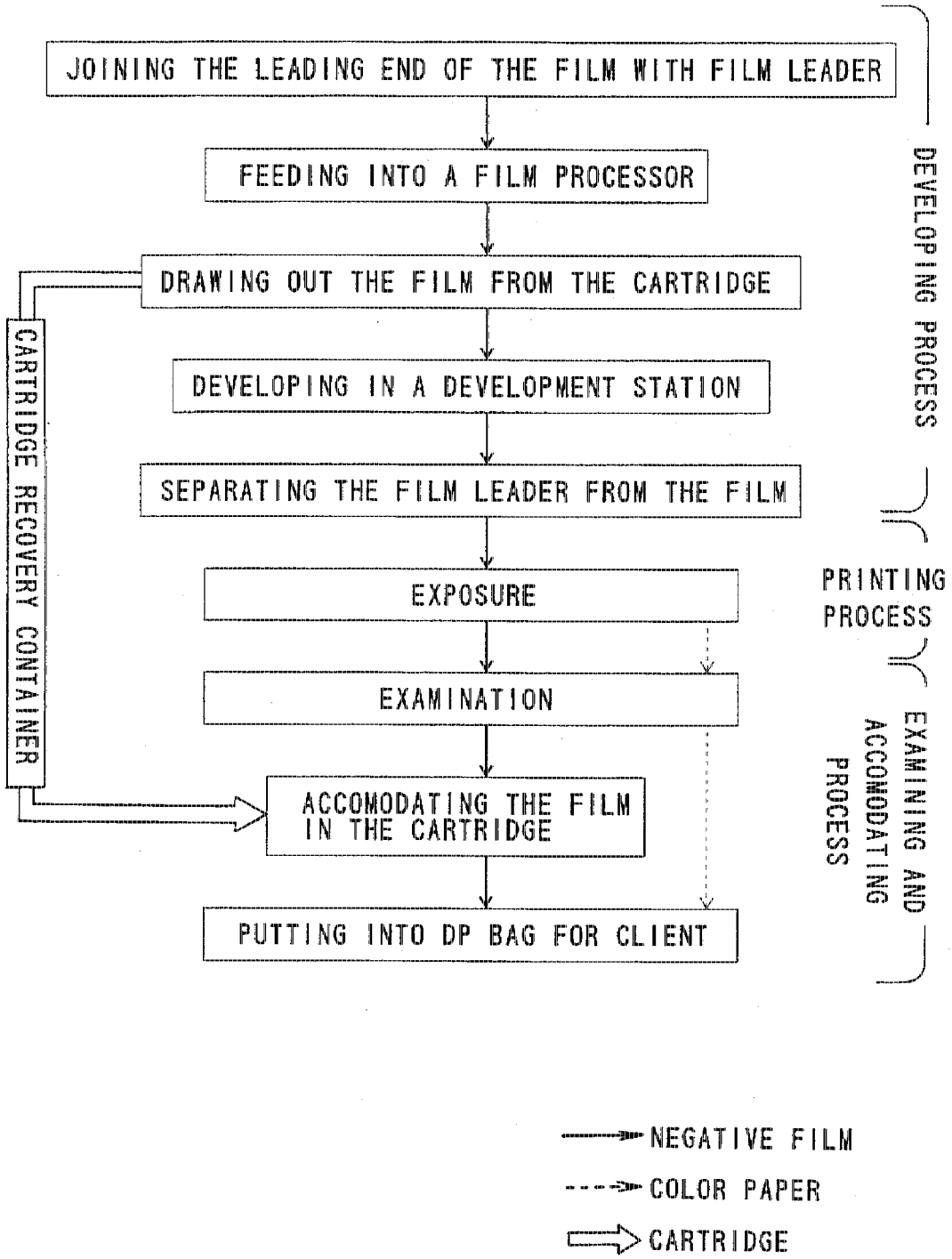
FIG. 23 is a flow chart of a photographic film processing method showing a still further embodiment of the present invention.

The steps of the photographic film processing method implemented in a processor system shown in FIG. 18 will now be explained referring to a flow chart of FIG. 23.

1. A spool 1A is rotated in the unloading direction to release the leading end of a film 2 from its cartridge 1.

2. The leading end of the film 2 is guided by guides 8*a* of a cartridge holder 8 and transferred to a splicer 6 while being nipped between a pair of feed rollers 5.

3. Also, a film leader 3 is supplied by the action of feed rollers 10 and carried along a film path by the action of transfer rollers 7 to the splicer 6.

Figure 19:
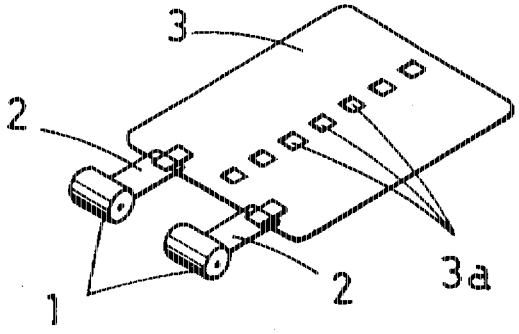
FIG. 19 is a perspective view showing joining of a film to a film leader according to the embodiment of FIG. 18.

4. The leading end of the film 2 is joined by a strip of slicing tape T to the film leader 3 in the splicer 6 (FIG. 19).

5. The film leader 3 with the film 2 is transferred by the action of the leader transfer rollers 7 to a development station 4.

Figure 20:
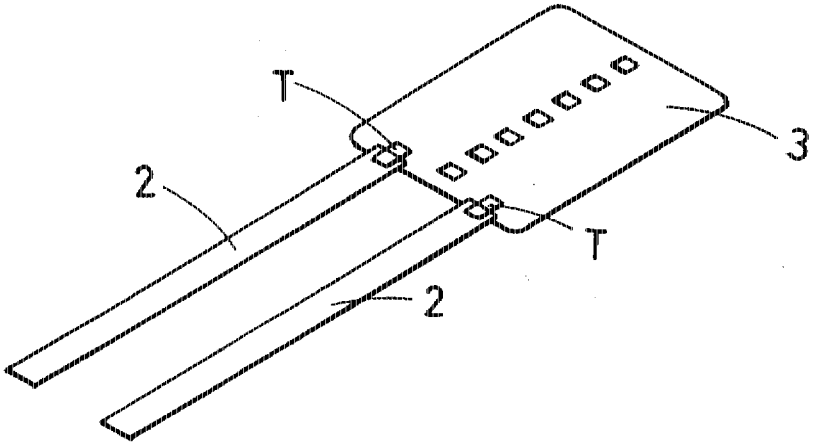
FIG. 20 is a perspective view showing joining of the film to the film leader according to the embodiment of FIG. 18.

6. When the trailing end of the film 2 is about to depart from the cartridge 1, its film end signal causes a solenoid 83*b* to actuate a film removal lever 82*b* for disengaging the trailing end of the film 2 from the spool 1A (FIG. 20).

The film end signal is released when an end mark recorded on the film 2 or a given rate of tension corresponding to near-end movement of the film 2 is detected.

7. When the film 2 has been separated from the spool 1A, the cartridge holder 8 is opened for discarding the cartridge 1 into a cartridge recovery container 11.

Upon the cartridge holder 8 being placed back to its original location, a cover 12 is opened for loading a succeeding cartridge 1.

Figure 21:
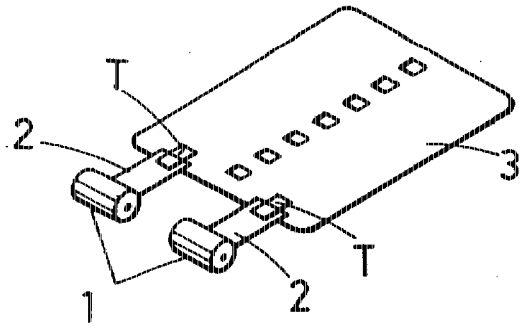
FIG. 21 is a perspective view showing joining of another film to a film leader according to the embodiment of FIG. 18.
Figure 22:
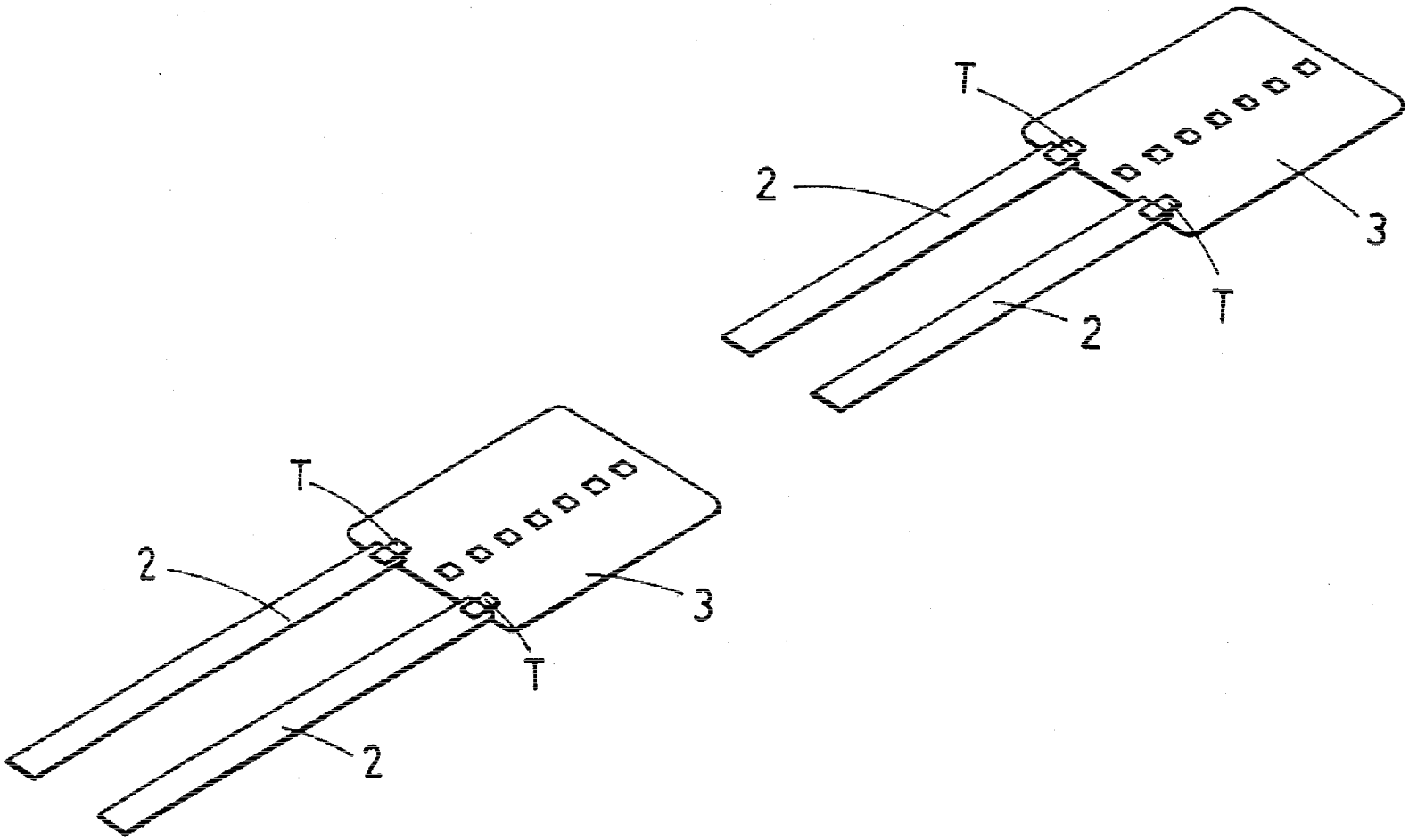
FIG. 22 is a perspective view showing joining of a further film according to the embodiment of FIG. 18.

8. By repeating the above steps, another film 2 of a full length is fed and subjected to the development process (FIGS. 21 and 22).

9. After the development process, the film leader 3 is recovered in the film leader recovery container 26 and the film 2 is taken up in the magazine 25.

10. The magazine containing a plurality of the developed films 2 is placed to the automatic negative mask station 20A provided with the automatic negative mask 20 in the printer processor B and the exposure process of an automatic printing action follows.

11. After the exposure process, each the film 2 is examined for corresponding to finished prints.

12. The film 2 is then accommodated in its cartridge 1 which is supplied by means of gravity drop from the cartridge recovery container 11.

13. The film 2 accommodated in the cartridge 1 is finally returned to a client with its finished prints in a DP bag.

A further or third embodiment of the present invention will be described in the form of a photographic film processing method.

This embodiment is distinguished from the second embodiment where each negative film 2 is subjected to the development process and then, the exposure process before being returned back by the fact that the negative film is subjected to the development process and returned back to a client without being subjecting to any printing action.

More particularly, the film 2 is subjected to the exposure process including the steps 1 to 8 in the film processor A of FIG. 18 and accommodated in its cartridge 1.

The cartridge recovery container 11 is thus located adjacent to an exit 4*a* of the film processor A where the developed film 2 is released out.

A further embodiment of the present invention in the form of a photographic film processor will be described referring to FIGS. 24 to 29.

Figure 24:
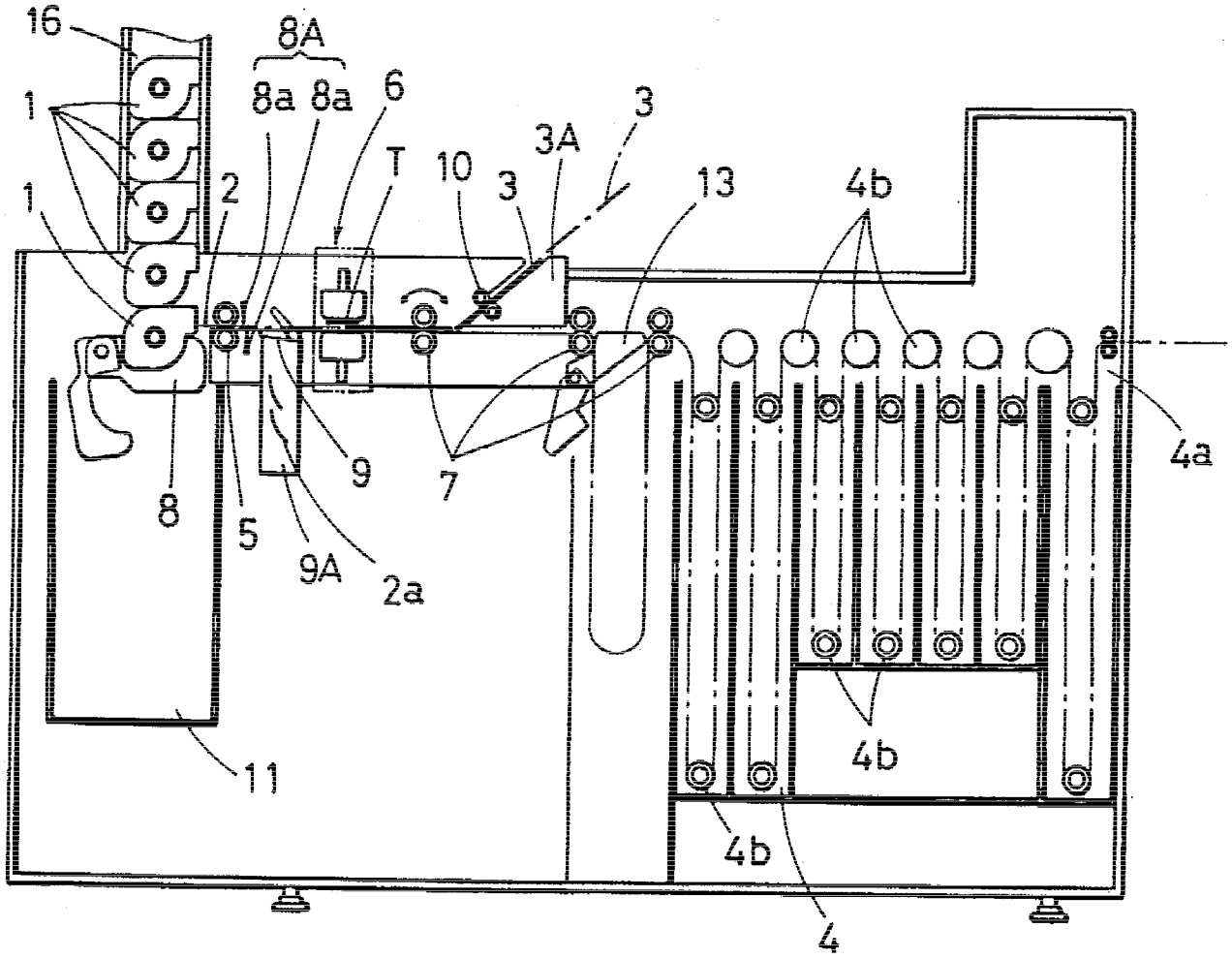
FIG. 24 is a front cross sectional view of a film processor showing a still further embodiment of the present invention.

The film processor of this embodiment allows a film 2 to be drawn out from a cartridge 1 and transferred as guided with a film leader 3 to a development station 4 for the development process. As shown in FIG. 24, the film processor comprises a pair of feed rollers 5 for feeding out the film 2 from its cartridge 1, a cutting means 8A for cutting off an end portion of the film 2, a splicer 6 for joining the leading end of the film 2 to the film leader 3, and a pair of leader transfer rollers (leader transfer means) 7 for transferring the film leader 3 with the film 2 to a the development station 4.

The splicer (joining means) 6 has also a function of joining the trailing end of the film 2 departed out from its cartridge 1 to the leading end of a succeeding film 2.

Figure 25:
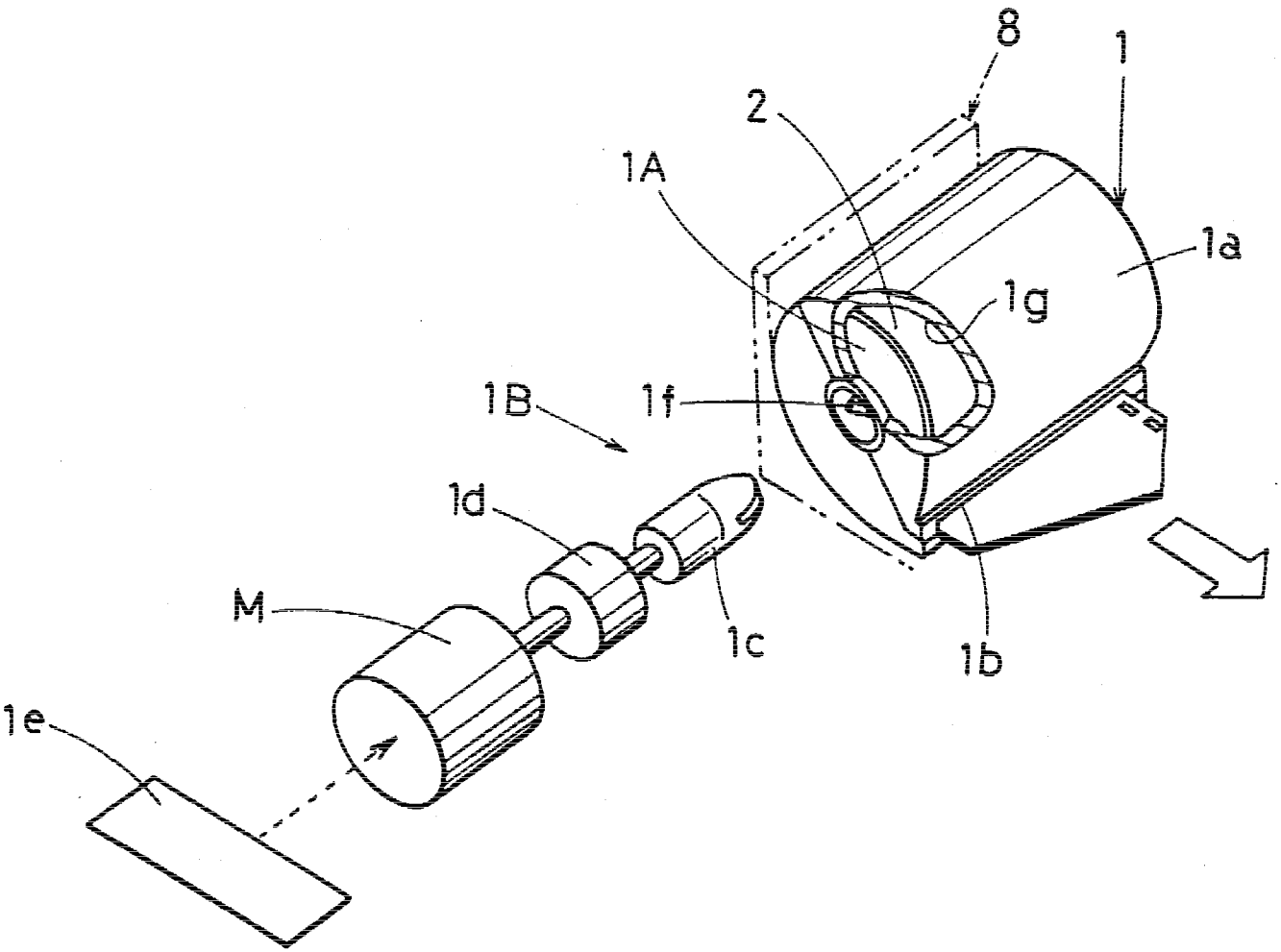
FIG. 25 is a perspective view of a film cartridge of the embodiment of FIG. 24.

FIG. 25 shows the cartridge 1 which is identical in the construction to that shown in FIG. 2 of the first embodiment and will be explained in no more detail as like components being denoted by like numerals.

The cutting means 8A comprises two, upper and lower, cutter blades 8*a* which cut off a leading portion and a trailing portion of the film 2 in response to a film start signal and a film end signal respectively.

The film start and end signals are released when a start mark and an end mark recorded on the film 2 are detected respectively.

The film leader 3 is provided for guiding the film 2 to a series of processing tubs in the development station 4 and made of a sheet of a resilient synthetic resin material. The film leader 3 has a row of perforations 3*a* provided in the center thereof at equal intervals lengthwisely of the film 2 (FIGS. 26 to 29). The film leader 3 is joined at its rear end by strips of a splicing tape T with two of the films 2 from their respective cartridges 1.

The film leader 3 is drawn out by a pair of feed rollers 10 from a leader storage 3A and transferred by leader transfer rollers 7 to the splicer 6 where it is placed in position.

The processing tubs in the development station 4 are provided for development, bleaching, settlement, rinsing, and drying processes. The developed film 2 is released from an exit 4*a* of the processor in the downstream side of a drying tub and rewound on a takeup reel.

A leader transfer roller means 4*b* which comprises sprockets and belts is provided along the processing tubs in the development station 4 so that the film leader 3 with the films 2 is advanced by action of the sprockets engaging with its perforations 3*a*.

There is a separation guide 9 provided for guiding a cut piece 2*a* separated from the film 2 to a discharge chute 9A by turning upward and directly passing the film 2 to the splicer 6 by turning downward.

The operation of the above film processor will now be explained.

1. A wanted cartridge 1 is loaded to a cartridge holder 15.

2. A spool 1A is rotated in the unloading direction to release the leading end of a film 2A from its cartridge 1.

3. The leading end of the film 2A is nipped between a pair of feed rollers 5 and drawn out from the cartridge 1.

4. The leading end of the film 2A is trimmed with the cutter blades 8*a* in response to the film start signal so that its joining ability to the film leader 3 is enhanced. A cut piece 2*a* separated from the film 2A is discarded by the separation guide 9 to the discharge chute 9A.

Figure 26:
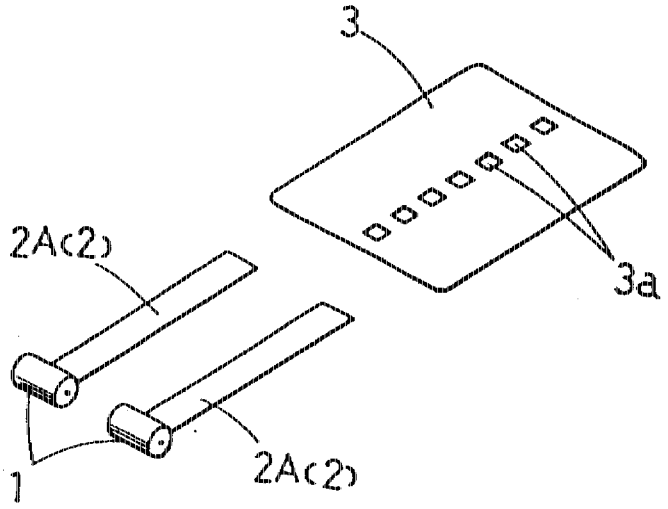
FIG. 26 is a perspective view showing joining of a film to a film leader according to the embodiment of FIG. 24.

5. The film 2A is nipped between the feed rollers 5 and passed across the separation guide 9 to the splicer 6 (FIG. 26).

6. Also, a film leader 3 is supplied by the feed rollers 10 and carried along a film path by the transfer rollers 7 to the splicer 6 where it is placed in position.

Figure 27:
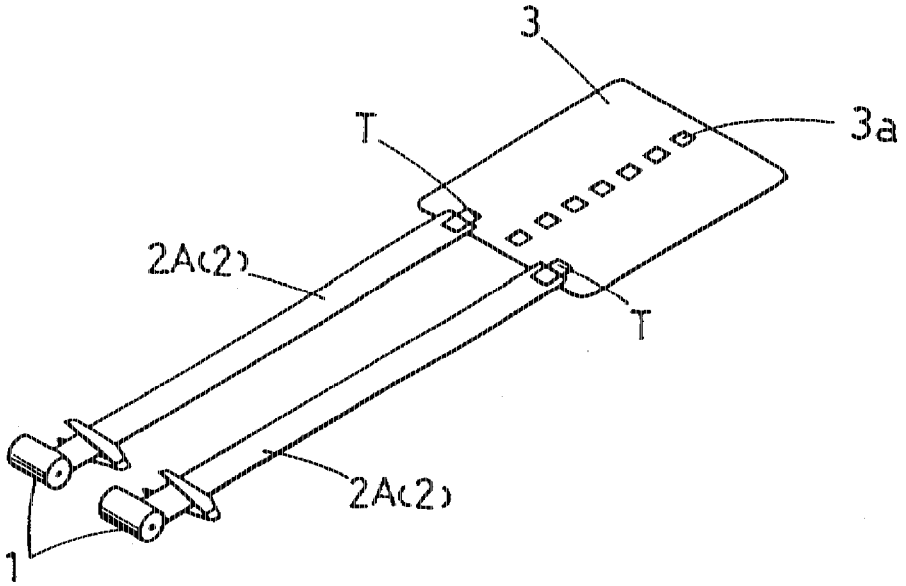
FIG. 27 is a perspective view showing joining of the film to the film leader according to the embodiment of FIG. 24.

7. The trimmed leading end of the film 2A is joined by a strip of the slicing tape T to the film leader 3 in the splicer 6 (FIG. 27).

This allows an operator of the film processor to be free from the step of joining by hand the film to the film leader.

8. The film leader 3 with the film 2A is transferred by the action of the leader transfer rollers 7 to the development station 4.

9. When the trailing end of the film 2A is about to depart from the cartridge 1, its film end signal causes the cutter blades 8*a* to cut and separate the film 2A from the cartridge 1.

Upon the trailing end of the film 2A reaching the splicer 6, the transfer movement of the processor is terminated.

A known film reservoir provided with an openable loop guide 13 for temporally holding a length of the film is mounted so that the development process is never affected by any delay of the joining action.

10. When the film 2A has been separated from the cartridge 1, a cartridge holder 8 is unlocked for discarding the cartridge 1 into a cartridge recovery container 11. Upon the cartridge holder 8 being placed back to its original location, it receives a succeeding cartridge 1 supplied by means of gravity drop from a cartridge container 16.

11. Another (or second) film 2B is drawn out from the succeeding cartridge 1 in the same manner and trimmed at the leading end with the cutter blades 8*a*. The trimmed film 2B is then advanced as nipped between the feed rollers 5 to the splicer 6.

Figure 28:
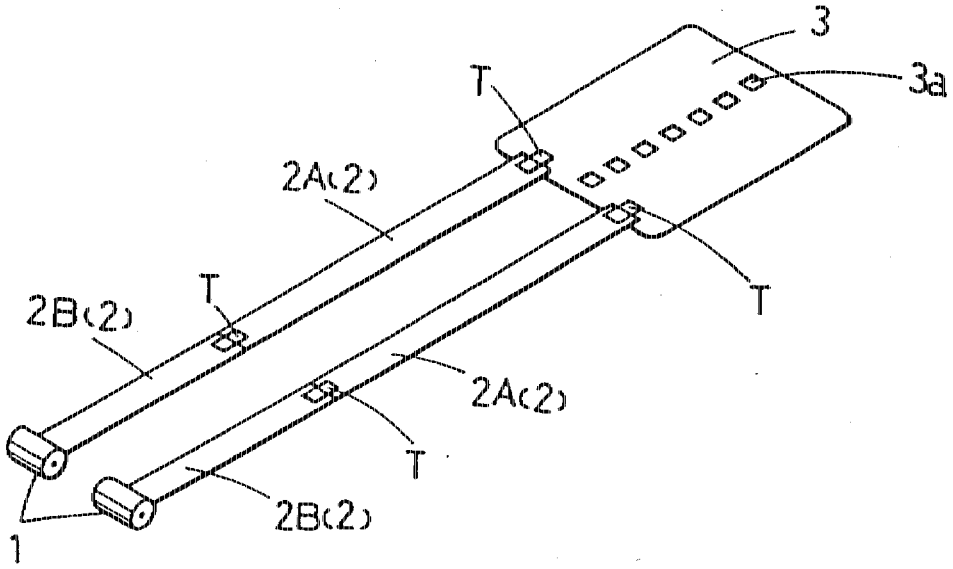
FIG. 28 is a perspective view showing joining of another film according to the embodiment of FIG. 24.

12. At the splicer 6, the leading end of the second film 2B is joined by a strip of the splicing tape T to the trailing end of the preceding or first film 2A (FIG. 28).

Figure 29:
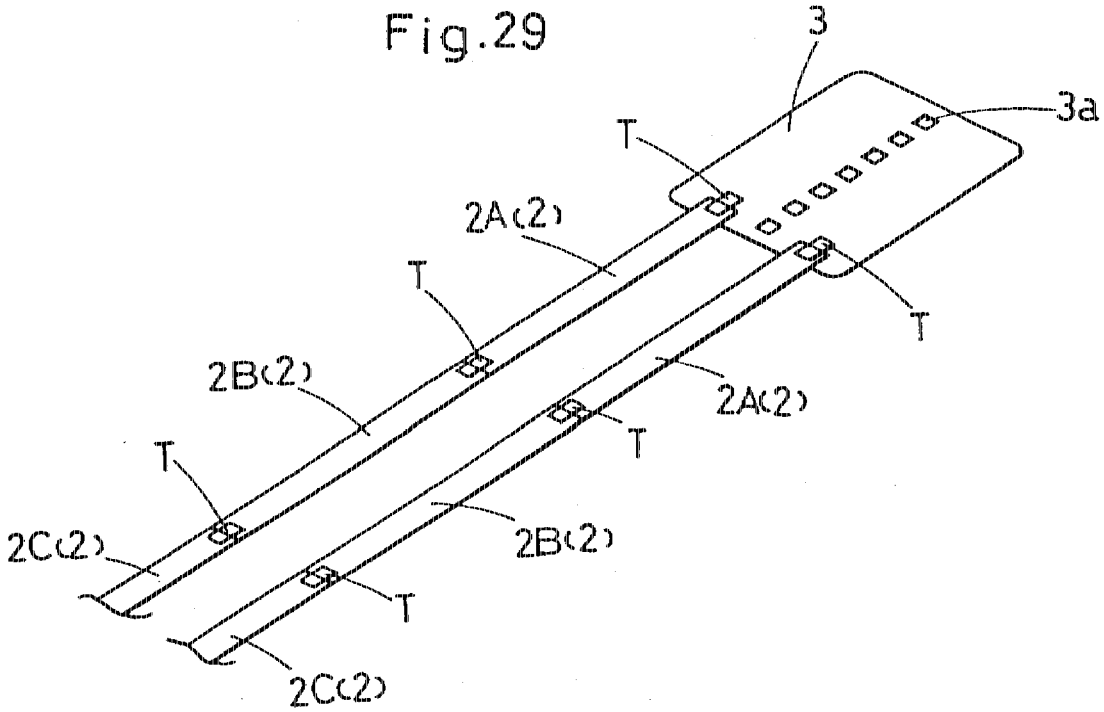
FIG. 29 is a perspective view showing joining of a further film according to the embodiment of FIG. 24.

13. By repeating the above steps, more of third, fourth, and so on of the films 2 are joined to one after another producing a string of the films (FIG. 29).

14. The string of the films 2A, 2B, 2C, . . . are subjected one after another to the development process of the development station 4.

15. After the development process, the film leader 3 is separated by a cutting means (not shown) from the first film 2A and the string of the developed films 2A, 2B, 2C, . . . are wound on a takeup reel.

16. The developed films 2A, 2B, 2C, . . . on the takeup reel are then loaded to a print processor for printing.

Figure 30:
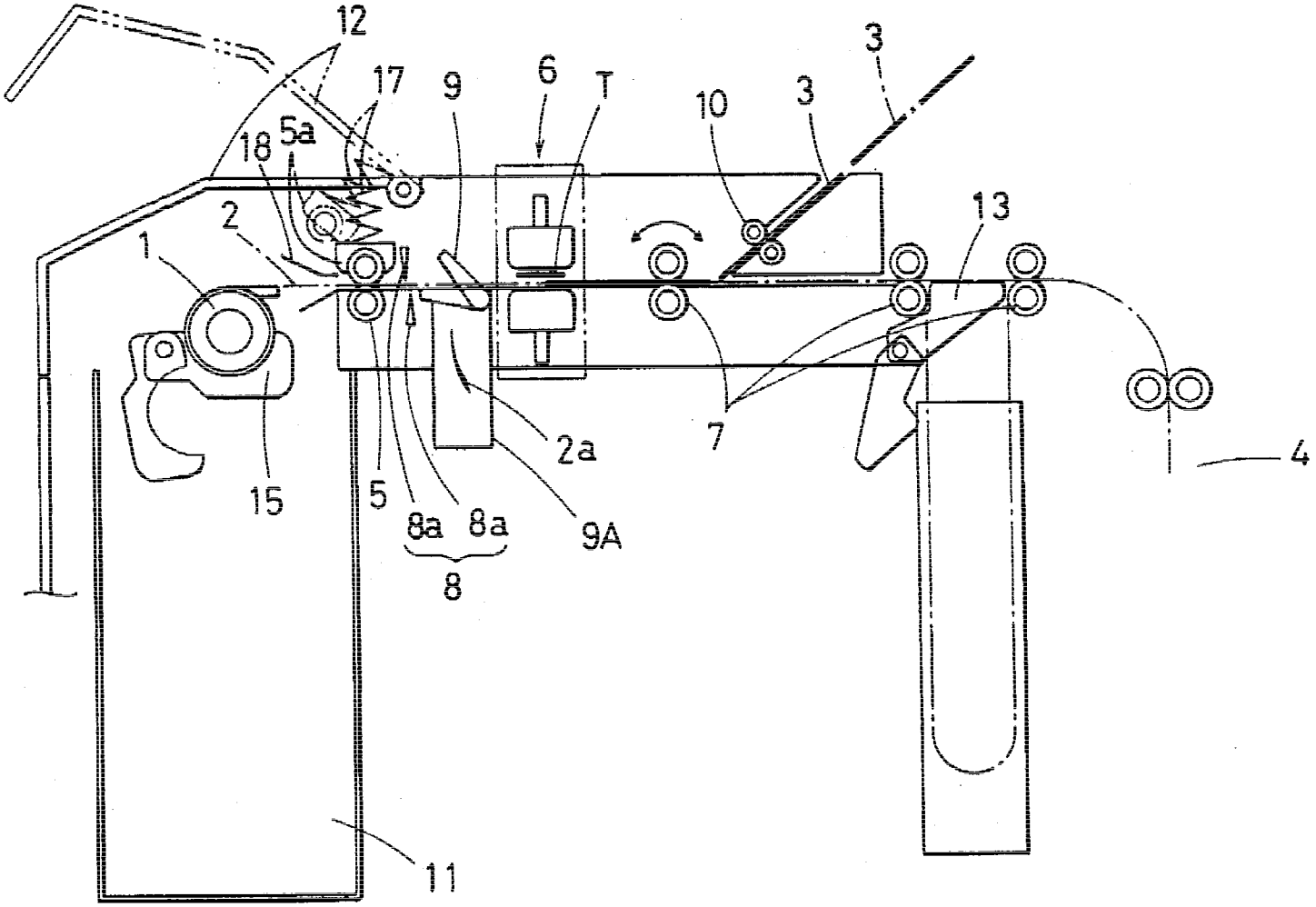
FIG. 30 is a cross sectional view of a film processor showing a still further embodiment of the present invention.
Figure 31:
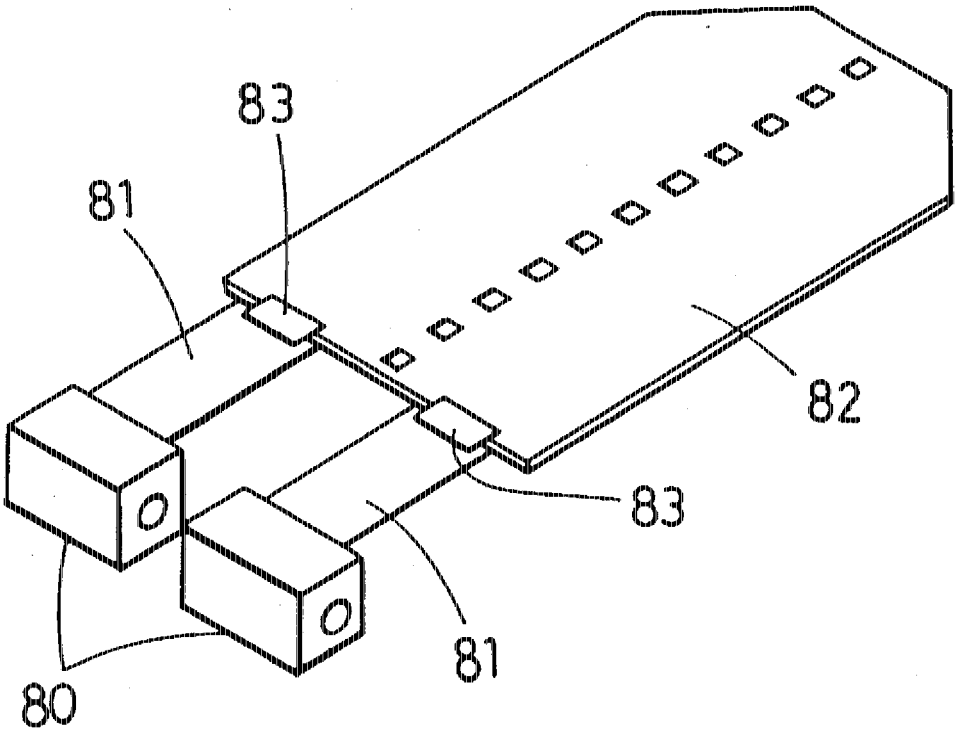
Prior Art Fig. 31
FIG. 31 is a perspective view showing a conventional photographic film processing method.

A further embodiment of the present invention will be described in the form of a film processor referring to FIG. 30.

This embodiment is associated with a common 35-mm photographic film cartridge while the particular film cartridge with a film leading end feeder means is used in the previous embodiments.

The film processor of the embodiment is identical in the construction to that shown in FIG. 24 and like components are denoted by like numerals and will be explained in no more details.

According to this embodiment, the cartridge container 16 is replaced with a mechanism where a cartridge 1 is placed to a cartridge holder 15 while a cover 12 is opened. In particular, an upper one of two feed rollers 5 is mounted by a compression spring 17 to the back side of the cover 12.

It is important that the leading end of a film 2A is drawn out from the cartridge 1 using a known tool (not shown) before the cartridge 1 is placed to the cartridge holder 15. In operation after the cover 12 is opened, the leading end of the film 2A is inserted into a guide 18 and its cartridge 1 is loaded to the cartridge holder 15. When the cover 12 has been closed, the leading end of the film 2A is advanced by the action of the feed rollers 5.

The trailing end of the film 2A is joined with the leading end of a succeeding film 2B in the same manner as of the previous embodiment shown in FIGS. 24 to 29 thus producing a string of the films 2. The string of the films 2 are then subjected to the development process and wound on a takeup reel.

What is claimed is:

1. A film processor for transferring a plurality of films supplied from a respective plurality of cartridges to a development station for development processing, said film processor comprising:

a feed mechanism for drawing out a leading end of a first film from its respective cartridge;

a splicer for splicing a film leader to the leading end of the first film drawn out by said feed mechanism to said splicer; and a leader transfer device for transferring the film leader having the leading end of the first film spliced thereto to the development station to cause a trailing end of the first film to arrive at said splicers;

said feed mechanism further being operable to draw out a leading end of a second film from its respective cartridge;

said splicer further being operable to splice the trailing end of the first film to the leading end of the second films; and said leader transfer device further being operable to transfer the film leader within the film development station to cause a trailing end of the second film to arrive at said splicer;

wherein third and subsequent films among the plurality of films are successively spliced together and transferred to the development station by said feed mechanism, said splicer and said leader transfer device to form a spliced together assembly having the leader at a leading end and a string of films connected to and trailing the leader, the string of films including the first, second, third and subsequent films, an endmost of the films defining a trailing end of the assembly and not being connected to the leading end of said assembly.

2. A film processor for transferring a plurality of films supplied from a respective plurality of cartridges to a development station for development processing, said film processor comprising:

a feed mechanism for drawing out a leading end of a first film from its respective first cartridge;

a splicer for splicing a film leader to the leading end of the first film drawn out by said feed mechanism to said splicer;

a separating device for separating a trailing end of the first film from the first cartridge; and a leader transfer device for transferring the film leader having the leading end of the first film spliced thereto to the development station to cause a trailing end of the first film to arrive at said splicer;

said feed mechanism further being operable to draw out a leading end of a second film from its respective second cartridge;

said splicer further being operable to splice the trailing end of the first film to the leading end of the second film;

said separating device further being operable to separate a trailing end of the second film from the second cartridge; and said leader transfer device further being operable to transfer the film leader within the film development station to cause a trailing end of the second film to arrive at said splicer;

wherein third and subsequent films among the plurality of films are successively spliced together and transferred to the development station by said feed mechanism, said splicer, said separating device and said leader transfer device to form a spliced together assembly having the leader at a leading end and a string of films connected to and trailing the leader, the string of films including the first, second, third and subsequent films, an endmost of the films defining a trailing end of the assembly and not being connected to the leading end of said assembly.

* * * * *